US008713715B1

(12) United States Patent
Lewis

(10) Patent No.: US 8,713,715 B1
(45) Date of Patent: May 6, 2014

(54) CROTCH ACCESS SYSTEM

(71) Applicant: Dorothy A. Lewis, Keithville, LA (US)

(72) Inventor: Dorothy A. Lewis, Keithville, LA (US)

( * ) Notice: Subject to any disclaimer, the term of this patent is extended or adjusted under 35 U.S.C. 154(b) by 0 days.

(21) Appl. No.: 14/022,037

(22) Filed: Sep. 9, 2013

Related U.S. Application Data

(63) Continuation-in-part of application No. 13/050,508, filed on Mar. 17, 2011, now abandoned.

(51) Int. Cl.
*A41D 1/06* (2006.01)

(52) U.S. Cl.
USPC ..... 2/227; 2/79

(58) Field of Classification Search
USPC ..... 2/69, 69.5, 79, 80, 83, 70, 901, 902, 2/904
See application file for complete search history.

(56) References Cited

U.S. PATENT DOCUMENTS

| | | | | |
|---|---|---|---|---|
| 1,374,040 | A | 4/1921 | Joodvin | |
| 2,138,588 | A | 11/1938 | Wan | |
| 2,355,193 | A | 8/1944 | Sylvester | |
| 2,482,349 | A | 9/1949 | Harry | |
| 2,627,604 | A | 2/1953 | Schor | |
| 3,555,567 | A | 1/1971 | Owen | |
| 4,497,071 | A * | 2/1985 | Bell | 2/94 |
| 4,638,509 | A | 1/1987 | Charron | |
| D289,222 | S | 4/1987 | Maejima | |
| D298,380 | S | 11/1988 | Clutts | |
| 4,914,756 | A | 4/1990 | Grassick | |
| 5,208,918 | A * | 5/1993 | Royal | 2/114 |
| 5,315,716 | A | 5/1994 | Baum | |
| 5,359,731 | A | 11/1994 | Cavalier | |
| 5,802,611 | A | 9/1998 | McKenzie et al. | |
| 5,864,888 | A | 2/1999 | Archer | |
| 6,108,815 | A | 8/2000 | Majerfeld | |
| 6,305,027 | B2 | 10/2001 | Chou | |
| 6,374,414 | B1 * | 4/2002 | Collier | 2/69 |
| 6,447,716 | B1 | 9/2002 | Cozar et al. | |
| 6,675,389 | B1 | 1/2004 | Kublick | |
| D505,772 | S | 6/2005 | Helbing et al. | |
| D654,662 | S | 2/2012 | Lewis | |
| 8,402,565 | B1 * | 3/2013 | Penner | 2/227 |
| 2004/0261156 | A1 * | 12/2004 | Lewis et al. | 2/227 |
| 2011/0067159 | A1 | 3/2011 | Smith | |

* cited by examiner

*Primary Examiner* — Katherine Moran

(57) ABSTRACT

A crotch access system for trousers, overalls, or coveralls features a rapid access closure at a crotch. The system features a leg covering garment having a first leg tube, a second leg tube, and a tubular torso component. A first leg first end and a second leg first end are attached to a tubular torso component second end intersecting at the crotch. The system features a first leg slit located on a first leg tube inside and a second leg slit located a second leg tube inside. The system features a first leg zipper located in the first leg slit and a second leg zipper located in the second leg slit for repeatedly opening and closing the second leg slit. The system features a first leg flap located over the first leg slit and a second leg flap located over the second leg slit.

9 Claims, 6 Drawing Sheets

(Front View)

(Detail View)

(Front View)

(Back View)

(Detail View)

Alternative Embodiment

CROTCH ACCESS SYSTEM

CROSS REFERENCE

This application claims priority to U.S. patent application Ser. No. 13/050,508, filed Mar. 17, 2011, the specification(s) of which is/are incorporated herein in their entirety by reference.

FIELD OF THE INVENTION

The present invention relates to trousers, overalls, or coveralls, or more specifically, trousers, overalls, or coveralls having an easy to open crotch area.

BACKGROUND OF THE INVENTION

Many times when wearing trousers, overalls, or coveralls, a person may need to use the restroom. Taking off the overalls or coveralls can be quite laborious, and although removing trousers is easier, it can still be time consuming—especially if the trousers are insulated. The present invention features a crotch access system for trousers, overalls, or coveralls featuring a rapid access closure at a crotch to make using the restroom easier for the wearer.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a crotch access system for trousers, overalls, or coveralls featuring a rapid access closure at a crotch. In some embodiments, the system comprises a leg covering garment having a first leg tube, a second leg tube, and a tubular torso component. In some embodiments, a first leg first end and a second leg first end are attached to a tubular torso component second end intersecting at a crotch.

In some embodiments, the system comprises a first leg slit located on a first leg tube inside and a second leg slit located a second leg tube inside. In some embodiments, the system comprises a first leg zipper located in the first leg slit for repeatedly opening and closing the first leg slit. In some embodiments, the system comprises a second leg zipper located in the second leg slit for repeatedly opening and closing the second leg slit.

In some embodiments, the system comprises a first leg flap located over the first leg slit via a permanent attachment on a first leg flap first edge and a temporary attachment on a first leg flap second edge consisting of a plurality of mated snap components. In some embodiments, the system comprises a second leg flap located over the second leg slit via a permanent attachment on a second leg flap first edge and a temporary attachment on a second leg flap second edge consisting of a plurality of mated snap components.

DESCRIPTION OF PREFERRED EMBODIMENTS

Figure 1:
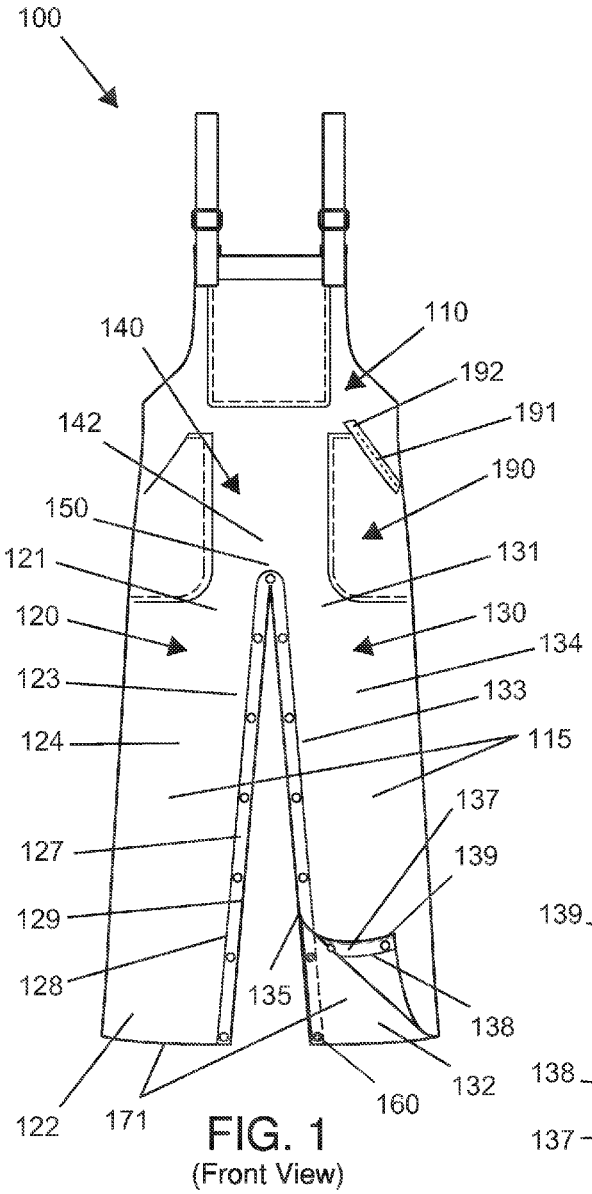
FIG. 1 shows a front view of the present invention.
Figure 2:
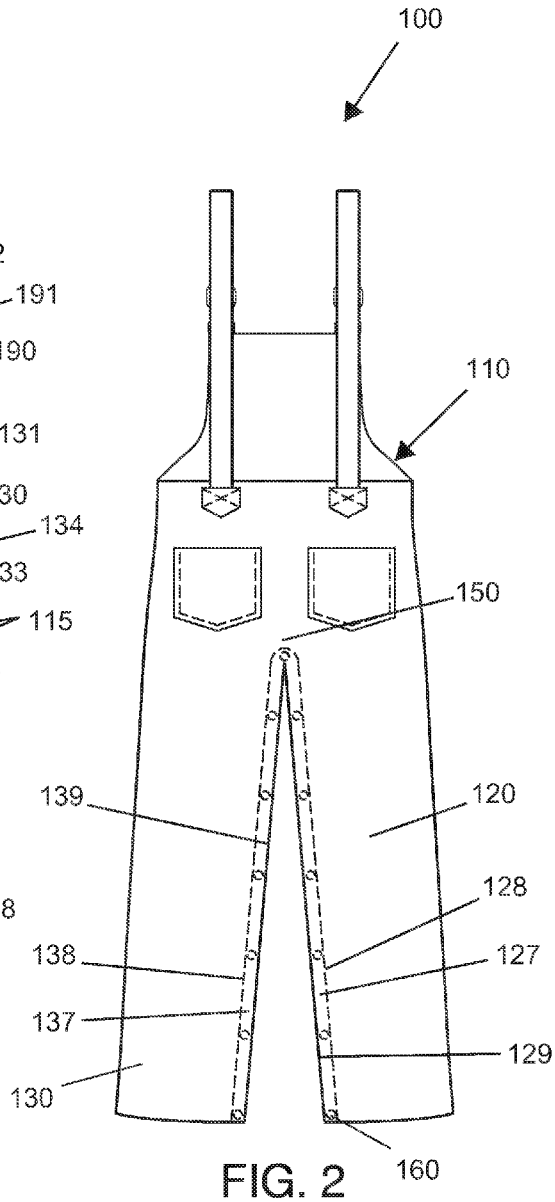
FIG. 2 shows a rear view of the present invention.
Figure 3:
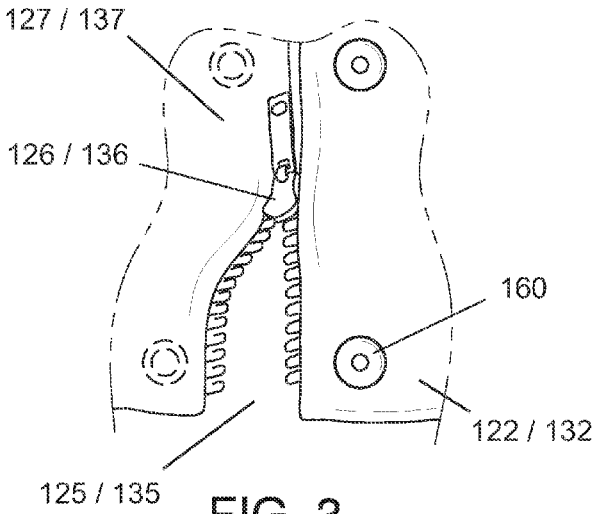
FIG. 3 shows a close-up view of the zipper, the snap component and the leg flap of the present invention.
Figure 4:
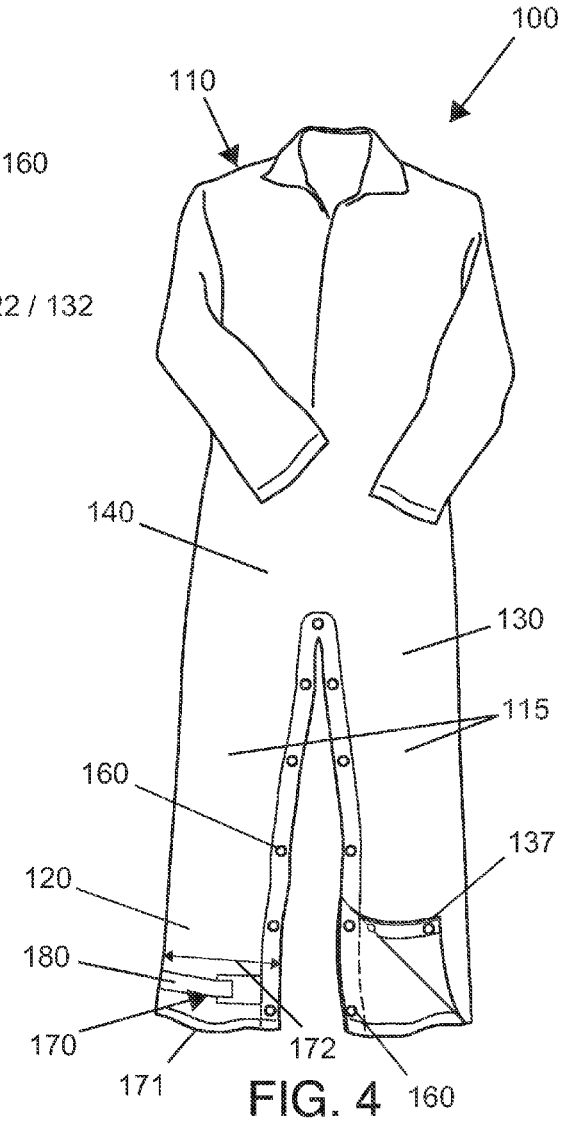
FIG. 4 shows a front view of an alternate embodiment of the present invention.
Figure 5:
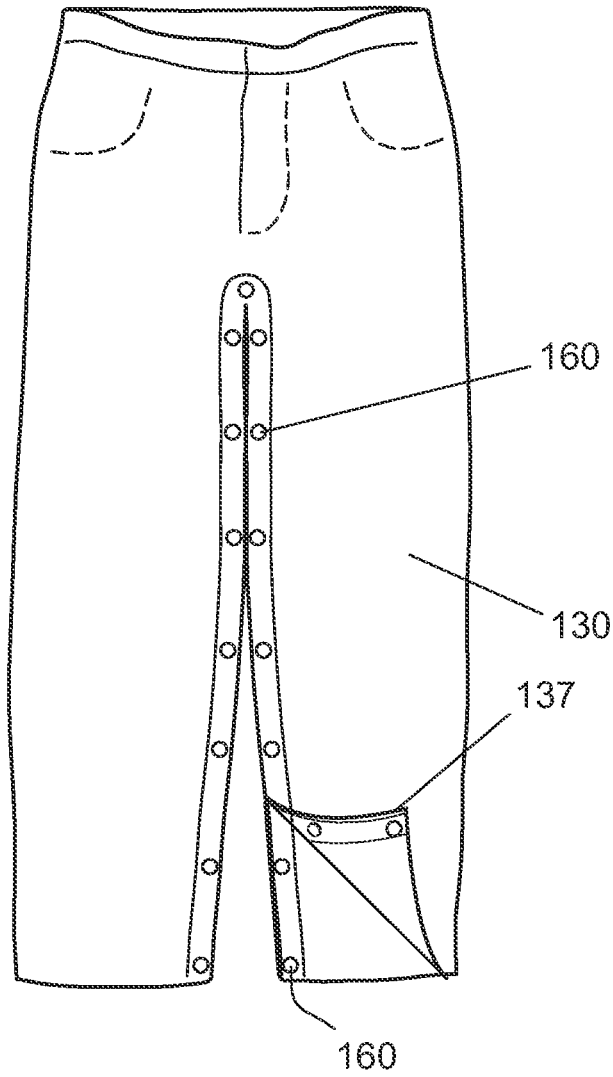
FIG. 5 shows a front view of an alternate embodiment of the present invention.

Following is a list of elements corresponding to a particular element referred to herein:

100 Crotch access system
110 Leg covering garment
115 Knee area
120 First leg tube
121 First leg first end
122 First leg second end
123 First leg tube inside
124 First leg tube outer surface
125 First leg slit
126 First leg zipper
127 First leg flap
128 First leg flap first edge
129 First lag flap second edge
130 Second leg tube
131 Second leg first end
132 Second leg second end
133 Second leg tube inside
134 Second leg tube outer surface
135 Second leg slit
136 Second leg zipper
137 Second leg flap
138 Second leg flap first edge
139 Second leg flap second edge
140 Tubular torso component
142 Tubular torso component second end
150 Crotch
160 Snap component
170 Adjustable cinch
171 Leg opening
172 Leg opening outer periphery
180 Strap
190 Pocket
191 Pocket opening
192 Pocket flap
201 First crotch flap
202 Second crotch flap
203 First crotch slit
204 Second crotch slit Referring now to FIG. 1-8, the present invention features a crotch access system (100) for trousers, overalls, or coveralls featuring a rapid access closure at a crotch. In some embodiments, the system (100) comprises a leg covering garment (110) having a first leg tube (120), a second leg tube (130), and a tubular torso component (140). In some embodiments, the first leg tube (120) comprises a first leg first end (121) and a first leg second end (122) and the second leg tube (130) comprises a second leg first end (131) and a second leg second end (132). In some embodiments, wherein the first leg first end (121) and the second leg first end (131) are attached to a tubular torso component second end (142) intersecting at a crotch (150). In some embodiments, the leg covering garment (110) is any garment that individually covers the legs of a wearer.

In some embodiments, the system comprises a first leg slit (125) located on a first leg tube inside (123) from first leg first end (121) to the first leg second end (122). In some embodiments, the system comprises a second leg slit (135) located a second leg tube inside (133) from second leg first end (131) to the second leg second end (132). In some embodiments, the first leg slit (125) and the second leg slit (135) are connected and continuous.

In some embodiments, the system comprises a first leg zipper (126) located in the first leg slit (125) from the first leg first end (121) to the first leg second end (122) for repeatedly opening and closing the first leg slit (125). In some embodiments, upon closing the first leg zipper (126), the first leg zipper (126) resides at the crotch (150). In some embodiments, the system comprises a second leg zipper (136) located in the second leg slit (135) from the second leg first end (131) to the second leg second end (132) for repeatedly opening and closing the second leg slit (135). In some embodiments, upon closing the second leg zipper (136), the second leg zipper (136) resides at the crotch (150).

In some embodiments, the system comprises a first leg flap (127) having a first leg flap first edge (128) and a first leg flap second edge (129). In some embodiments, the first leg flap (127) is removably located over the first leg slit (125) via a permanent attachment on the first leg flap first edge (128) and a temporary attachment on the first leg flap second edge (129) consisting of a plurality of mated snap components (160). In some embodiments, the first leg flap (127) fully covers the first leg zipper (126).

In some embodiments, the system comprises a second leg flap (137) having a second leg flap first edge (138) and a second leg flap second edge (139). In some embodiments, the second leg flap (137) is removably located over the second leg slit (135) via a permanent attachment on the second leg flap first edge (138) and a temporary attachment on the second leg flap second edge (139) consisting of a plurality of mated snap components (160). In some embodiments, the second leg flap (137) fully covers the second leg zipper (136).

In some embodiments, the first leg flap (127) and the second leg flap (137) provide an additional securing means to seal the first leg slit (125) and the second leg slit (135) in addition to the first leg zipper (126) and the second leg zipper (136). In some embodiments, the first leg flap (127) and the second leg flap (137) provide a seal over the first leg zipper (126) and the second leg zipper (136) to keep out a draft. In some embodiments, either the first leg zipper (126) and the second leg zipper (136) are used to secure the first leg slit (125) and the second leg slit (135) respectively, or alternately, the snap components (160) on the first leg flap (127) and the second leg flap (137) are used to secure the first leg slit (125) and the second leg slit (135).

In some embodiments, for use, the leg covering garment (110) is donned by a user. In some embodiments, the first leg flap (127) and the second leg flap (137) are unsnapped from the crotch (150) to at least a knee area (115) of each leg tube. In some embodiments, the first leg zipper (126) and the second leg zipper (136) are unzipped from the crotch (150) to at least the knee area (115) of each leg tube to create an adequate opening. In some embodiments, the first leg flap (127) and the second leg flap (137) are entirely unsnapped and the first leg zipper (126) and the second leg zipper (136) are entirely unzipped to create an adequate opening. In some embodiments, the crotch (150) is fully open via unsnapping the first leg flap (127) and the second leg flap (137) and unzipping the first leg zipper (126) and the second leg zipper (136).

In some embodiments, the leg covering garment (110) is a pair of trousers. In some embodiments, the leg covering garment (110) is a pair of bib overalls. In some embodiments, the leg covering garment (110) is a pair of coveralls.

In some embodiments, a first adjustable cinch (170) is located close to a first leg opening (171) of the first leg second end (122) and a second adjustable cinch (170) is located close to a second leg opening (171) of the second leg second end (132). In some embodiments, the first adjustable cinch (170) surrounds a first leg second end (122) leg opening outer periphery (172) and the second adjustable cinch (170) surrounds a second leg second end (132) leg opening outer periphery (172). In some embodiments, each adjustable cinch (170) comprises a first hook and loop component located on a strap (180). In some embodiments, each strap (180) is firmly located on either a first leg tube outer surface (124) or a second leg tube outer surface (134). In some embodiments, a second hook and loop component is located on each first leg tube outer surface (124) close to the first strap (180) or second leg tube outer surface (134) close to the second strap (180). In some embodiments, each strap (180) is drawn to cinch either the first leg opening (171) or the second leg opening (171) against a leg of a user and removably fasten to the second hook and loop component.

In some embodiments, the leg covering garment (110) comprises a pocket (190). In some embodiments, a pocket flap (192) is located over a pocket opening (191).

In some embodiments, a crotch access system (100) for trousers, overalls, or coveralls featuring a rapid access closure at a crotch. In some embodiments, the system (100) consists of a leg covering garment (110) having a first leg tube (120), a second leg tube (130), and a tubular torso component (140). In some embodiments, the first leg tube (120) consists of a first leg first end (121) and a first leg second end (122) and the second leg tube (130) consists of a second leg first end (131) and a second leg second end (132). In some embodiments, the first leg first end (121) and the second leg first end (131) are attached to a tubular torso component second end (142) intersecting at a crotch (150).

In some embodiments, the system consists of a first leg slit (125) located on a first leg tube inside (123) from first leg first end (121) to the first leg second end (122). In some embodiments, the system consists of a second leg slit (135) located a second leg tube inside (133) from second leg first end (131) to the second leg second end (132).

In some embodiments, the system consists of a first leg zipper (126) located in the first leg slit (125) from the first leg first end (121) to the first leg second end (122) for repeatedly opening and closing the first leg slit (125). In some embodiments, upon closing the first leg zipper (126), the zipper resides at the crotch (150). In some embodiments, the system consists of a second leg zipper (136) located in the second leg slit (135) from the second leg first end (131) to the second leg second end (132) for repeatedly opening and closing the second leg slit (135). In some embodiments, upon closing the second leg zipper (136), the zipper resides at the crotch (150).

In some embodiments, the system consists of a first leg flap (127) having a first leg flap first edge (128) and a first leg flap second edge (129). In some embodiments, the first leg flap (127) is removably located over the first leg slit (125) via a permanent attachment on the first leg flap first edge (128) and a temporary attachment on the first leg flap second edge (129) consisting of a plurality of mated snap components (160). In some embodiments, the first leg flap (127) fully covers the first leg zipper (126). In some embodiments, the system consists of a second leg flap (137) having a second leg flap first edge (138) and a second leg flap second edge (139). In some embodiments, the second leg flap (137) is removably located over the second leg slit (135) via a permanent attachment on the second leg flap first edge (138) and a temporary attachment on the second leg flap second edge (139) consisting of a plurality of mated snap components (160). In some embodiments, the second leg flap (137) fully covers the second leg zipper (136), In some embodiments, for use, the leg covering garment (110) is donned by a user. In some embodiments, the first leg flap (127) and the second leg flap (137) are unsnapped from the crotch (150) to at least a knee area (115) of each leg tube. In some embodiments, the first leg zipper (126) and the second leg zipper (136) are unzipped from the crotch (150) to at least the knee area (115) of each leg tube to create an adequate opening. In some embodiments, the crotch (150) is fully open via unsnapping the first leg flap (127) and the second leg flap (137) and unzipping the first leg zipper (126) and the second leg zipper (136).

In some embodiments, a crotch access system (100) for trousers, overalls, or coveralls features a rapid access closure at a crotch. In some embodiments, the system (100) consists of a first adjustable cinch (170) located close to a first leg opening (171) of the first leg second end (122) and a second adjustable cinch (170) located close to a second leg opening (171) of the second leg second end (132). In some embodiments, the first adjustable cinch (170) surrounds a first leg second end (122) leg opening outer periphery (172) and the second adjustable cinch (170) surrounds a second leg second end (132) leg opening outer periphery (172). In some embodiments, each adjustable cinch (170) consists of a first hook and loop component located on a strap (180). In some embodiments, each strap (180) is firmly located on either a first leg tube outer surface (124) or a second leg tube outer surface (134). In some embodiments, a second hook and loop component is located on each first leg tube outer surface (124) close to the first strap (180) or second leg tube outer surface (134) close to the second strap (180). In some embodiments, each strap (180) is drawn to cinch either the first leg opening (171) or the second leg opening (171) against a leg of a user and removably fasten to the second hook and loop component.

Figure 6:
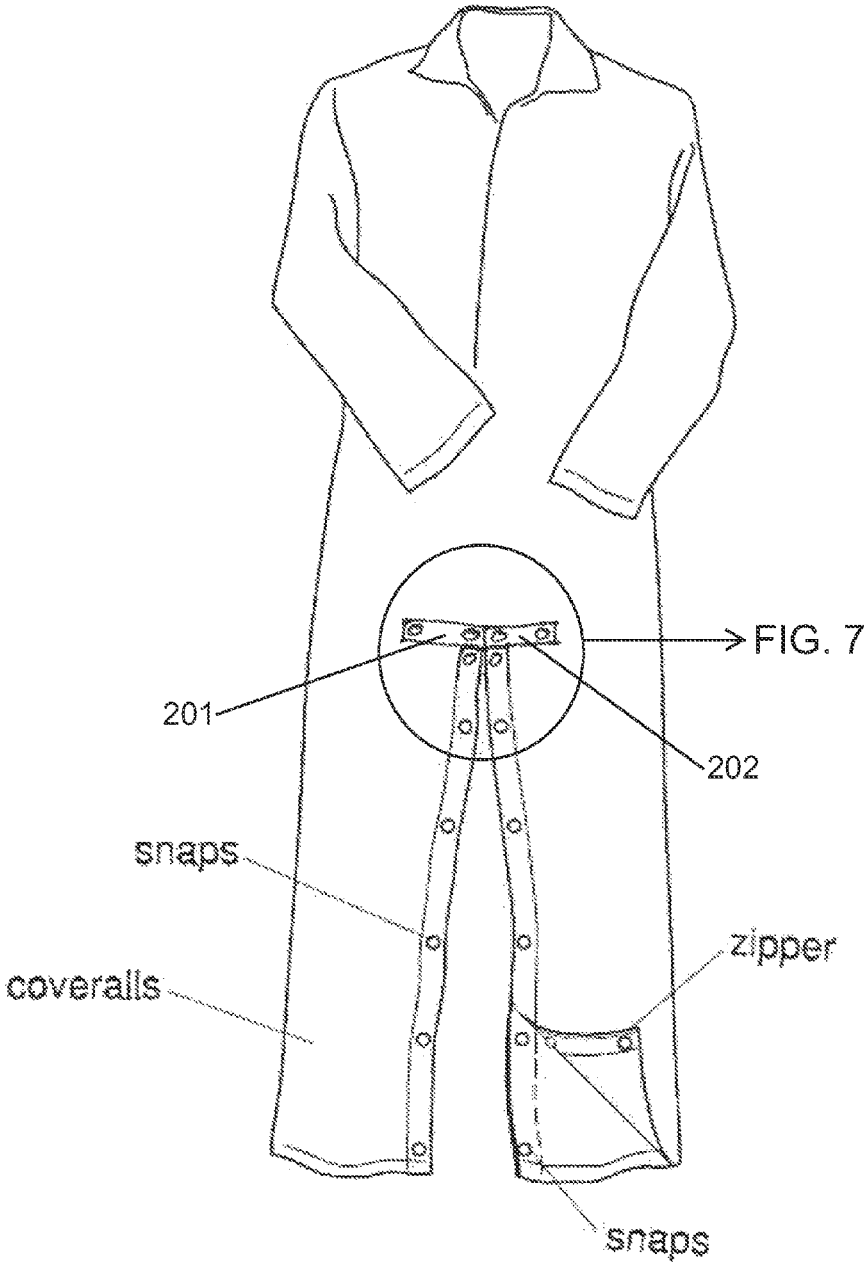
FIG. 6 shows an alternative embodiment of the present invention.
Figure 7:
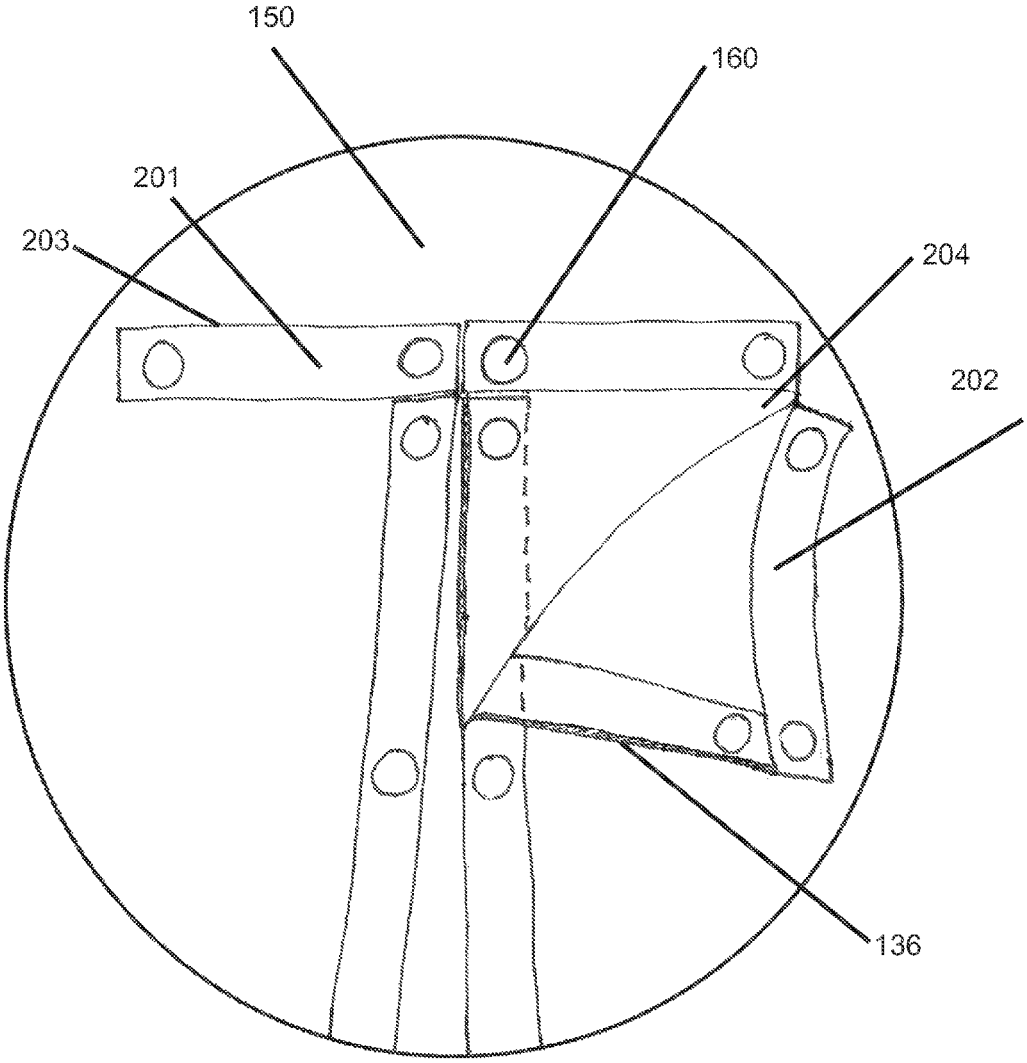
FIG. 7 is a close-up view of the zipper, the snap component and the crotch flap of FIG. 6.
Figure 8:
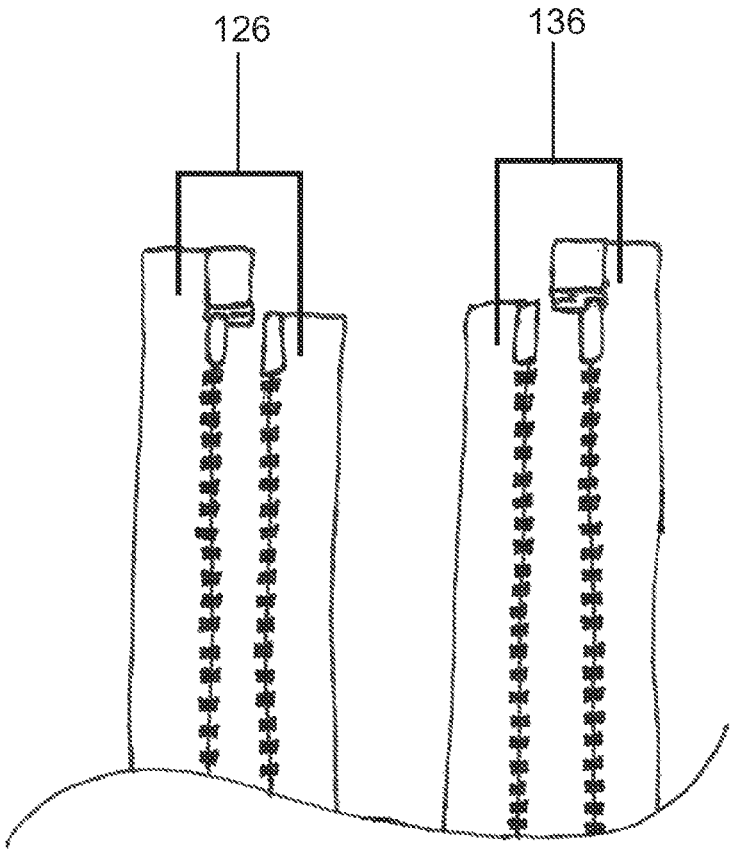
FIG. 8 shows a close-up view of the zipper component in FIG. 6.

As seen in FIGS. 6-8, in some embodiments, the system comprises a first crotch flap (201) and a second crotch flap (202) located at the crotch (150), wherein the first crotch flap (201) and the second crotch flap (202) comprises a plurality of mated snap components (160). In some embodiments, the first crotch flap (201) seals a first crotch slit (203). In some embodiments, the second crotch flap (202) seals a second crotch slit (204). In some embodiments, the snap components (160) on the first crotch flap (201) and the second crotch flap (202) are used to secure the first crotch slit (203) and the second crotch slit (204) respectively.

In some embodiments, the system consists of a pocket (190) located on the leg covering garment (110). In some embodiments, a pocket flap (192) is located over a pocket opening (191).

As used herein, the term "about" refers to plus or minus 10% of the referenced number.

The disclosures of the following U.S. Patents are incorporated in their entirety by reference herein: U.S. Pat. No. 6,108,815; U.S. Pat. No. 5,208,918; and U.S. Pat. No. 4,914,756.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "consisting of" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A crotch access system (100) for trousers, overalls, or coveralls featuring a rapid access closure at a crotch, wherein the system (100) comprises:

(a) a leg covering garment (110) having a first leg tube (120), a second leg tube (130), and a tubular torso component (140), wherein the first leg tube (120) comprises a first leg first end (121) and a first leg second end (122) and the second leg tube (130) comprises a second leg first end (131) and a second leg second end (132), wherein the first leg first end (121) and the second leg first end (131) are attached to a tubular torso component second end (142) intersecting at a crotch (150);

(b) a first leg slit (125) disposed on a first leg tube inside (123) from the first leg first end (121) to the first leg second end (122);

(c) a second leg slit (135) disposed on a second leg tube inside (133) from the second leg first end (131) to the second leg second end (132);

(d) a first leg zipper (126) disposed in the first leg slit (125) from the first leg first end (121) to the first leg second end (122) for repeatedly opening and closing the first leg slit (125), wherein upon closing the first leg zipper (126), the first leg zipper (126) resides at the crotch (150);

(e) a second leg zipper (136) disposed in the second leg slit (135) from the second leg first end (131) to the second leg second end (132) for repeatedly opening and closing the second leg slit (135), wherein upon closing the second leg zipper (136), the second leg zipper (136) resides at the crotch (150);

(f) a first leg flap (127) having a first leg flap first edge (128) and a first leg flap second edge (129), wherein the first leg flap (127) is removably disposed over the first leg slit (125) via a permanent attachment on the first leg flap first edge (128) and a temporary attachment on the first leg flap second edge (129) consisting of a plurality of mated snap components (160), wherein the first leg flap (127) fully covers the first leg zipper (126);

(g) a second leg flap (137) having a second leg flap first edge (138) and a second leg flap second edge (139), wherein the second leg flap (137) is removably disposed over the second leg slit (135) via a permanent attachment on the second leg flap first edge (138) and a temporary attachment on the second leg flap second edge (139) consisting of a plurality of mated snap components (160), wherein the second leg flap (137) fully covers the second leg zipper (136);

wherein for use, the leg covering garment (110) is donned by a user, wherein the first leg flap (127) and the second leg flap (137) are unsnapped from the crotch (150) to at least a knee area (115) of each leg tube, wherein the first leg zipper (126) and the second leg zipper (136) are unzipped from the crotch (150) to at least the knee area (115) of each leg tube to create an adequate opening, wherein the crotch (150) is fully open via unsnapping the first leg flap (127) and the second leg flap (137) and unzipping the first leg zipper (126) and the second leg zipper (136).

2. The system (100) of claim 1, wherein the leg covering garment (110) is a pair of trousers.

3. The system (100) of claim 1, wherein the leg covering garment (110) is a pair of bib overalls.

4. The system (100) of claim 1, wherein the leg covering garment (110) is a pair of coveralls.

5. The system (100) of claim 1, wherein a first adjustable cinch (170) is disposed proximal to a first leg opening (171) of the first leg second end (122) and a second adjustable cinch (170) is disposed proximal to a second leg opening (171) of the second leg second end (132), wherein the first adjustable cinch (170) surrounds a first leg second end leg opening outer periphery (172) and the second adjustable cinch (170) surrounds a second leg second end leg opening outer periphery (172), wherein each adjustable cinch (170) comprises a first hook and loop component disposed on a strap (180), wherein each strap (180) is firmly disposed on either a first leg tube outer surface (124) or a second leg tube outer surface (134), wherein a second hook and loop component is disposed on each first leg tube outer surface (124) proximal to the first strap (180) or second leg tube outer surface (134) proximal to the second strap (180), wherein each strap (180) is drawn to cinch either the first leg opening (171) or the second leg opening (171) against a leg of a user and removably fasten to the second hook and loop component.

6. The system (100) of claim 1, wherein the leg covering garment (110) comprises a pocket (190), wherein a pocket flap (192) is disposed over a pocket opening (191).

7. The system (100) of claim 1 further comprising a first crotch flap (201) and a second crotch flap (202) located at the crotch (150), wherein the first crotch flap (201) and the second crotch flap (202) comprises a plurality of mated snap components (160), wherein the first crotch flap (201) seals a first crotch slit (203), wherein the second crotch flap (202) seals a second crotch slit (204), wherein the snap components (160) on the first crotch flap (201) and the second crotch flap (202) secure the first crotch slit (203) and the second crotch slit (204) respectively.

8. A crotch access system (100) for trousers, overalls, or coveralls featuring a rapid access closure at a crotch, wherein the system (100) consists of:

(a) a leg covering garment (110) having a first leg tube (120), a second leg tube (130), and a tubular torso component (140), wherein the first leg tube (120) consists of a first leg first end (121) and a first leg second end (122) and the second leg tube (130) consists of a second leg first end (131) and a second leg second end (132), wherein the first leg first end (121) and the second leg first end (131) are attached to a tubular torso component second end (142) intersecting at a crotch (150);

(b) a first leg slit (125) disposed on a first leg tube inside (123) from the first leg first end (121) to the first leg second end (122);

(c) a second leg slit (135) disposed on a second leg tube inside (133) from the second leg first end (131) to the second leg second end (132);

(d) a first leg zipper (126) disposed in the first leg slit (125) from the first leg first end (121) to the first leg second end (122) for repeatedly opening and closing the first leg slit (125), wherein upon closing the first leg zipper (126), the zipper resides at the crotch (150);

(e) a second leg zipper (136) disposed in the second leg slit (135) from the second leg first end (131) to the second leg second end (132) for repeatedly opening and closing the second leg slit (135), wherein upon closing the second leg zipper (136), the zipper resides at the crotch (150);

(f) a first leg flap (127) having a first leg flap first edge (128) and a first leg flap second edge (129), wherein the first leg flap (127) is removably disposed over the first leg slit (125) via a permanent attachment on the first leg flap first edge (128) and a temporary attachment on the first leg flap second edge (129) consisting of a plurality of mated snap components (160), wherein the first leg flap (127) fully covers the first leg zipper (126);

(g) a second leg flap (137) having a second leg flap first edge (138) and a second leg flap second edge (139), wherein the second leg flap (137) is removably disposed over the second leg slit (135) via a permanent attachment on the second leg flap first edge (138) and a temporary attachment on the second leg flap second edge (139) consisting of a plurality of mated snap components (160), wherein the second leg flap (137) fully covers the second leg zipper (136);

wherein for use, the leg covering garment (110) is donned by a user, wherein the first leg flap (127) and the second leg flap (137) are unsnapped from the crotch (150) to at least a knee area (115) of each leg tube, wherein the first leg zipper (126) and the second leg zipper (136) are unzipped from the crotch (150) to at least the knee area (115) of each leg tube to create an adequate opening, wherein the crotch (150) is fully open via unsnapping the first leg flap (127) and the second leg flap (137) and unzipping the first leg zipper (126) and the second leg zipper (136).

9. A crotch access system (100) for trousers, overalls, or coveralls featuring a rapid access closure at a crotch, wherein the system (100) consists of:

(a) a leg covering garment (110) having a first leg tube (120), a second leg tube (130), and a tubular torso component (140), wherein the first leg tube (120) consists of a first leg first end (121) and a first leg second end (122) and the second leg tube (130) consists of a second leg first end (131) and a second leg second end (132), wherein the first leg first end (121) and the second leg first end (131) are attached to a tubular torso component second end (142) intersecting at a crotch (150);

(b) a first leg slit (125) disposed on a first leg tube inside (123) from the first leg first end (121) to the first leg second end (122);

(c) a second leg slit (135) disposed on a second leg tube inside (133) from the second leg first end (131) to the second leg second end (132);

(d) a first leg zipper (126) disposed in the first leg slit (125) from the first leg first end (121) to the first leg second end (122) for repeatedly opening and closing the first leg slit (125), wherein upon closing the first leg zipper (126), the zipper resides at the crotch (150);

(e) a second leg zipper (136) disposed in the second leg slit (135) from the second leg first end (131) to the second leg second end (132) for repeatedly opening and closing the second leg slit (135), wherein upon closing the second leg zipper (136), the zipper resides at the crotch (150);

(f) a first leg flap (127) having a first leg flap first edge (128) and a first leg flap second edge (129), wherein the first leg flap (127) is removably disposed over the first leg slit (125) via a permanent attachment on the first leg flap first edge (128) and a temporary attachment on the first leg flap second edge (129) consisting of a plurality of mated snap components (160), wherein the first leg flap (127) fully covers the first leg zipper (126);

(g) a second leg flap (137) having a second leg flap first edge (138) and a second leg flap second edge (139), wherein the second leg flap (137) is removably disposed over the second leg slit (135) via a permanent attachment on the second leg flap first edge (138) and a temporary attachment on the second leg flap second edge (139) consisting of a plurality of mated snap components (160), wherein the second leg flap (137) fully covers the second leg zipper (136);

(h) a first adjustable cinch (170) disposed proximal to a first leg opening (171) of the first leg second end (122) and a second adjustable cinch (170) disposed proximal to a second leg opening (171) of the second leg second end (132), wherein the first adjustable cinch (170) surrounds a first leg second end leg opening outer periphery (172) and the second adjustable cinch (170) surrounds a second leg second end leg opening outer periphery (172), wherein each adjustable cinch (170) consists of a first hook and loop component disposed on a strap (180), wherein each strap (180) is firmly disposed on either a first leg tube outer surface (124) or a second leg tube outer surface (134), wherein a second hook and loop component is disposed on each first leg tube outer surface (124) proximal to the first strap (180) or second leg tube outer surface (134) proximal to the second strap (180), wherein each strap (180) is drawn to cinch either the first leg opening (171) or the second leg opening (171) against a leg of a user and removably fasten to the second hook and loop component; and (i) a pocket (190) disposed on the leg covering garment (110), wherein a pocket flap (192) is disposed over a pocket opening (191);

wherein for use, the leg covering garment (110) is donned by a user, wherein the first leg flap (127) and the second leg flap (137) are unsnapped from the crotch (150) to at east a knee area (115) of each leg tube, wherein the first leg zipper (126) and the second leg zipper (136) are unzipped from the crotch (150) to at least the knee area (115) of each leg tube to create an adequate opening, wherein the crotch (150) is fully open via unsnapping the first leg flap (127) and the second leg flap (137) and unzipping the first leg zipper (126) and the second leg zipper (136).

* * * * *